United States Patent [19]

Strasser

[11] 4,211,391

[45] Jul. 8, 1980

[54] CLAMPING FRAME FOR MAKING RECTANGULAR FRAMES, PARTICULARLY PICTURE FRAMES

[76] Inventor: Peter Strasser, Münchner Strasse 31, D-8184 Gmund, Fed. Rep. of Germany

[21] Appl. No.: 48,043

[22] Filed: Jun. 13, 1979

[30] Foreign Application Priority Data

Jun. 24, 1978 [DE] Fed. Rep. of Germany ..... 2827772

[51] Int. Cl.[2] ..... B25B 5/14

[52] U.S. Cl. ..... 269/41; 269/116

[58] Field of Search ..... 269/41, 42, 111, 115–117

[56] References Cited

U.S. PATENT DOCUMENTS

| | | | |
|---|---|---|---|
| 835,809 | 11/1906 | Bramhall | 269/116 |
| 1,608,406 | 11/1926 | McFarland | 269/116 |
| 1,692,675 | 11/1928 | Markham | 269/115 |
| 1,702,676 | 2/1929 | Vocisano | 269/117 |
| 2,619,136 | 11/1952 | Nash | 269/116 |

*Primary Examiner*—Robert C. Watson

[57] ABSTRACT

In the manufacture of frames, particularly wooden frames, the glued faces have to be pressed together along the bevelled cuts. For this purpose a clamping frame is suggested which comprises a closed rectangular clamping frame consisting of a first frame portion (10) consisting of two limbs (10*a*, 10*b*) at right-angles to each other and a second frame portion (16) consisting of two limbs (16*a*, 16*b*) at right-angles to each other. The second frame portion (16) is displaceable relatively to the first frame portion (10) and the limbs (16*a*, 16*b*) of the second frame portion (16) project outwardly beyond the limbs (10*a*, 10*b*) of the first frame portion (10). On the outside of the limbs (10*a*, 10*b*) of the first frame portion and parallel thereto there are pull rods (18) which intersect at the corner of the first frame portion (10) and engage the projecting limb sections of the second frame portion (16). Clamps (22) can be applied to the sections of the limbs of the second frame portion (16) that project beyond the limbs of the first frame portion (10) as well as to the pull rods (18), which clamps are supported on the outside of the limbs of the first frame portion (10) and with which the second frame portion (16) can be tightened to the first frame portion (10). By means of such a clamping frame, frames of different size can be clamped simply and conveniently.

6 Claims, 1 Drawing Figure

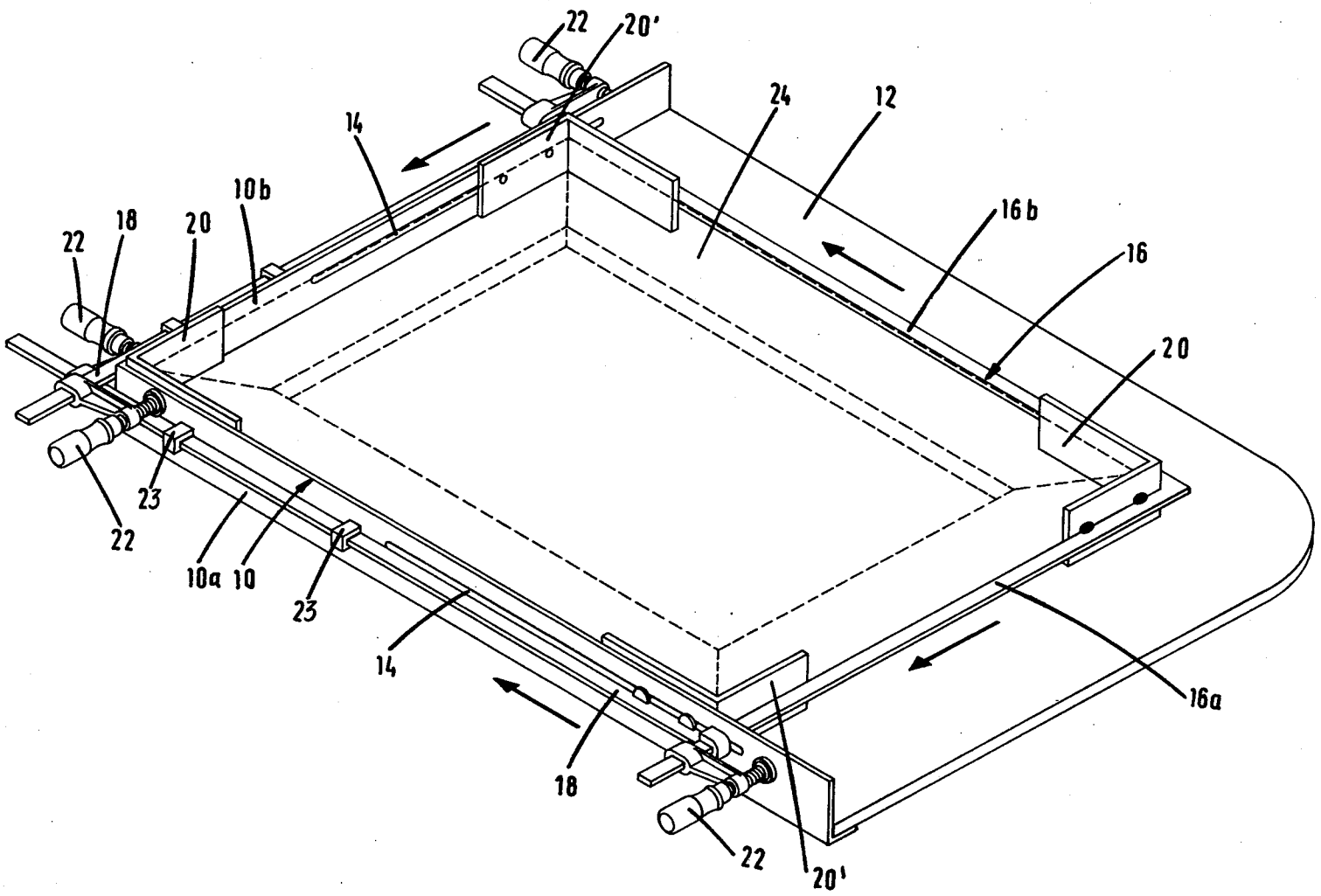
16a
20
16
16b
12
24
20'
22
18
14
23
10
10a
10b
20
18
22
22
23
14
20'
22

CLAMPING FRAME FOR MAKING RECTANGULAR FRAMES, PARTICULARLY PICTURE FRAMES

The invention relates to a clamping frame for making rectangular frames, particularly picture frames. In the manufacture of frames, particularly wooden frames such as window frames, picture frames and the like, it is necessary to press the glued faces together along their bevelled cuts. It is the object of the invention to provide a clamping frame or mitre frame for making rectangular frames and which permits the clamping of frames of different sizes in a simple and convenient manner.

According to the invention, this object is achieved in that a first frame portion comprising two limbs at right-angles to each other and a second frame portion comprising two limbs at right-angles to each other together define a closed rectangular clamping frame, the second frame portion being displaceable relatively to the first frame portion and the limbs of the second frame portion projecting outwardly beyond the limbs of the first frame portion, that pull rods are provided parallel to the limbs of the first frame portion on the outside thereof, which rods intersect at the corner of the first frame portion and engage the projecting limb sections of the second frame portion, and that spring clamps are provided for tightening the second frame portion to the first frame portion, which clamps can be applied to the sections of the limbs of the second frame portion projecting beyond the limbs of the first frame portion as well as to the pull rods and which are supported on the outside of the limbs of the first frame portion.

Desirably, the limbs of the second frame portion are guided in longitudinal slots in the limbs of the first frame portion.

In a further development of the invention, the pull rods are mounted at the outside of the limbs of the first frame portion in guide members which are rigidly connected to the first frame portion.

It is also of advantage for the corners of the closed frame defined by the two frame portions to be associated with right-angled angle members which come to abut directly against the picture frame to be clamped, wherein the angle members associated with the corner of each frame portion are rigidly connected to the frame portion whereas the other two angle members are displaceably guided on the limbs of the first frame portion, preferably in the longitudinal slots for guiding the limbs of the second frame portion.

It has been found particularly desirable to provide a base plate on which the two frame portions are mounted.

Other advantages, details and features of the invention will become evident from the following description of a preferred example with reference to the single FIGURE of the accompanying drawing.

As will be evident from the drawing, a rigid frame portion 10 consisting of two limbs 10*a*, 10*b* at right-angles to each other are so secured to a base plate 12 that the limbs 10*a* and 10*b*, which are L-shaped in cross-section, engage under the base plate 12. The limbs 10*a* and 10*b* of the frame portion 10 each have a longitudinal slot 14. Limbs 16*a*, 16*b* of a second rigid frame portion 16 extend at right-angles to each other and pass through a respective one of the longitudinal slots 14. The second frame portion 16 together with the first frame portion 10 defines a rectangular clamping frame of which the size can be altered by displacing the second frame portions 16 relatively to the first frame portion 10.

A pull rod 18 is provided on the outside of each limb 10*a*, 10*b* of the first frame portion 10 and extends parallel to the respective limb. The pull rods are guided in U-shaped guide members 23 and engage the respective associated limb 16*a*, 16*b* of the second frame portion. The connection between each pull rod 18 and limb 16*a* or 16*b* is such that the limb 16*a* or 16*b* can be displaced lengthwise relatively to the pull rod. As will also be evident from the drawing, the pull rods are so located that they intersect at the corner of the first frame portion 10.

The corners of the clamping frame consisting of the two frame portions 10 and 16 which are associated with angle members 20. The angle members of which the arms extend along only a comparatively short section of the limbs 10*a*, 10*b*, 16*a*, 16*b* are rigidly connected to the frame portions 10 or 16 at the corners thereof whereas the other angle members 20', which are associated with the corners formed by the intersections of the limbs 10*a*, 16*a* or 10*b*, 16*b*, are displaceably guided in the longitudinal slots 14 and loosely abut the limbs 16*a*, 16*b* of the second frame portion 16. The last-mentioned angle members 20' to a large extent contribute to a rectangular alignment of the clamping frame.

Clamps which can be in the form of screw clamps 22 are arranged on the outwardly projecting sections of the limbs 16*a*, 16*b* of the second frame portion 16 as well as on the pull rods 18 and they are supported on the outside of the limbs 10*a*, 10*b* of the first frame portion 10. As will be evident from the drawing, with the aid of the clamps 22 the second frame portion 16 can be so tightened relatively to the first frame portion 10 for the purpose of clamping a frame 24 indicated in broken lines so that the frame will be compressed from all sides. The use of the pull rods 18 ensures that the tensile forces indicated by arrows in the drawings can be divided up in the sense of loading the frame uniformly. The angle members 20, 20' arranged on the inside and with which the clamped frame 24 comes into abutment ensure that the right-angle of the frame 24 is maintained during clamping, i.e. that the corners of the clamped frame 24 are not subjected to a load that might deform the rectangular configuration of the frame 24.

I claim:

1. A clamping frame for making rectangular frames, particularly picture frames, characterised in that a first frame portion (10) comprising two limbs (10*a*, 10*b*) at right-angles to each other and a second frame portion (16) comprising two limbs (16*a*, 16*b*) at right-angles to each other together define a closed rectangular clamping frame, the second frame portion (16) being displaceable relatively to the first frame portion (10) and the limbs (16*a*, 16*b*) of the second frame portion (16) project outwardly beyond the limbs (10*a*, 10*b*) of the first frame portion (10), that pull rods (18) are provided parallel to the limbs (10*a*, 10*b*) of the first frame portion on the outside thereof, which rods intersect at the corner of the first frame portion (10) and engage the projecting limb sections of the second frame portion (16), and that clamps (22) are provided for tightening the second frame portion (16) to the first frame portion (10), which clamps can be applied to the sections of the limbs of the second frame portion (16) projecting beyond the limbs of the first frame portion (10) as well as to the pull rods (18) and which are supported on the outside of the limbs of the first frame portion (10).

2. A clamping frame according to claim 1, characterised in that the limbs (16*a*, 16*b*) of the second frame portion (16) are guided in longitudinal slots (14) in the limbs (10*a*, 10*b*) of the first frame portion (10).

3. A clamping frame according to claim 1 or claim 2, characterised in that the pull rods (18) are mounted at the outside of the limbs (10*a*, 10*b*) of the first frame portion (10) in guide members (20) rigidly connected to the first frame portion (10).

4. A clamping frame according to claim 2, characterised in that the corners of the closed frame defined by the two frame portions (10, 16) are associated with right-angled angle members (20, 20′) which come to abut directly against the picture frame to be clamped, wherein the angle members (20) associated with the corner of each frame portion (10, 16) are rigidly connected to the frame portion (10, 16) whereas the other two angle members (20′) are displaceably guided on the limbs (10*a*, 10*b*) of the first frame portion (10), preferably in the longitudinal slots (14) for guiding the limbs (16*a*, 16*b*) of the second frame portion (16).

5. A clamping frame according to claim 1, characterised in that a base plate (12) is provided on which the two frame portions (10, 16) are mounted.

6. A clamping frame for making rectangular frames, particularly picture frames, characterized in that there is provided a base plate (12), a first frame portion (10) comprising two limbs (10*a*, 10*b*) at right-angles to each other mounted on said base plate and a second frame portion (16) comprising two limbs (16*a*,16*b*) at right angles to each other mounted on said base plate, said frame portions together defining a closed rectangular clamping frame, the limbs of the second frame portion being guided in longitudinal slots (14) in the limbs of the first frame portion whereby the second frame portion is displaceable relatively to the first frame portion, the limbs of the second frame portion projecting outwardly beyond the limbs of the first frame portion, pull rods (18) are mounted at the outside of the limbs of the first frame portion and parallel thereto in guide members (23) rigidly connected to the first frame portion, which rods intersect at the corner of the first frame portion and engage the projecting limb sections of the second frame portion, right-angled members (20,20′) associated with the corners of the closed frame defined by the two frame portions which come to abut directly against the picture frame to be clamped, the angle members (20) associated with the corner of each frame portion being rigidly connected to the frame portion, the other two angle members (20′) being displaceably guided on the limbs of the first frame portion, preferably in the longitudinal slots (14) for guiding the limbs of the second frame portion, and clamps (22) are provided for tightening the second frame portion to the first frame portion supported on the outside of the limbs of the first frame portion, which clamps can be applied to the sections of the limbs of the second frame portion projecting beyond the limbs of the first frame portion as well as to the pull rods.

* * * * *